US005439187A

United States Patent [19]

Shimizu

[11] Patent Number: 5,439,187

[45] Date of Patent: Aug. 8, 1995

[54] METHOD AND DEVICE FOR TAKING UP TOILET PAPER

[75] Inventor: Akira Shimizu, Fuji, Japan

[73] Assignees: Shimizu Machinery Co., Ltd.; Masukoh Paper Co., Ltd., both of Shizuoka; Hiroshi Genda, Tokyo, all of Japan

[21] Appl. No.: 119,529

[22] Filed: Sep. 13, 1993

Related U.S. Application Data

[63] Continuation of Ser. No. 909,838, Jul. 7, 1992, abandoned.

[51] Int. Cl.[6] ..... B65H 18/02

[52] U.S. Cl. ..... 242/541.7

[58] Field of Search ..... 242/66, 541.4, 541.7

[56] References Cited

U.S. PATENT DOCUMENTS

| | | | |
|---|---|---|---|
| 1,768,407 | 6/1930 | Johnstone | 242/66 |
| 2,654,546 | 10/1953 | Hornbostel | 242/66 |
| 2,670,152 | 2/1954 | Priest | 242/66 |
| 2,677,508 | 5/1954 | Locke | 242/66 |
| 4,266,736 | 5/1981 | Schonmeier | 242/541.4 |
| 4,434,949 | 3/1984 | Karr | 242/66 |
| 4,512,528 | 4/1985 | Kuhn | 242/66 |
| 4,602,749 | 11/1986 | Vanhoutte | 242/541.4 |
| 4,967,804 | 11/1990 | Gotti | 242/541.7 |

FOREIGN PATENT DOCUMENTS 2193849 7/1990 Japan .

*Primary Examiner*—Daniel P. Stodola
*Assistant Examiner*—Eileen A. Dunn
*Attorney, Agent, or Firm*—Nikaido Marmelstein Murray & Oram

[57] ABSTRACT

A shaft for taking up toilet paper adapted to rotate circumferentially is maintained parallel with respect to supporting devices for supporting toilet paper. A take-up device is provided with fixing devices for maintaining the shaft for taking up toilet paper so as to rotate circumferentially parallel with respect to supporting devices for supporting toilet paper. The position of the shaft with respect to the supporting devices is accurately maintained parallel at all times, and thus, the taking-up pressure of toilet paper can be made uniform. Moreover, even if the shaft is rotated at high speed, toilet paper can accurately be taken up, thereby making it possible to improve the quality of the toilet paper roll.

5 Claims, 3 Drawing Sheets

METHOD AND DEVICE FOR TAKING UP TOILET PAPER

This application is a continuation of application Ser. No. 07/909,838 filed Jul. 7, 1992, now abandoned.

BACKGROUND OF THE INVENTION

The present invention relates to a method and device for taking up toilet paper, especially one without a core.

A conventional toilet paper take-up device is disclosed in Japanese patent application Kokai publication No. 2-193849. In this device, as shown in FIGS. 3 to 5, a shaft 2 is disposed above a portion where rolls 1A and 1B rotating in a direction shown by an arrow R are provided adjacent to each other.

Wide material paper for toilet paper P is then fed between the shaft 2 and roll 1A as shown by an arrow F, and is taken up around the shaft 2. During this taking-up operation, toilet paper P taken up around the shaft 2 is pressed from above by means of a roll 1C so as to prevent the generation of surface waviness on the toilet paper P. Furthermore, when a taking-up operation of toilet paper P is started, air is sent from between the shaft 2 and roll 1B as shown by an arrow A so that the leading end of the toilet paper P is brought into tight contact with the outer circumferential surface of the shaft 2.

During the taking-up operation, the protruding portions 2A at the ends of the shaft 2 are supported by means of fixing devices 4. As the diameter of toilet paper P that is being taken up around the shaft 2 increases, the contact surface pressure generated between the rolls 1A and 1B on one hand and toilet paper P on the other hand increases. In order to maintain the contact surface pressure at a certain level, cylinders 15 provided at the ends of the shaft 2 are driven so as to raise the fixing devices 4 along guide rails 11.

Thus, the taking-up pressure of toilet paper P is made as uniform as possible by driving the fixing devices 4 so as to prevent the local generation of a too tightly-taken-up state on toilet paper P. In addition, the generation of deflection and warpage of the shaft 2 is prevented also by driving the fixing devices 4 so as to restrain the increase of the aforesaid contact surface pressure.

However, in this conventional device, since the cylinders 15 provided at the ends of the shaft 2 are driven separately, the travelling speeds and distances of the two fixing devices 4 that are caused to rise along the guide rails 11 are not equal to each other exactly. Due to this, the shaft 2 is not accurately maintained parallel with respect to the rolls 1A and 1B.

Therefore, a uniform taking-up pressure for toilet paper P can not be obtained to a sufficient extent, and in the case where the shaft 2 is rotated, for example, at about 300 rpm to 500 rpm, a too-tightly taken-up state tends to easily be generated at one end of the toilet paper P. This causes a draw-back in that toilet paper P may be taken up in a longitudinally deviated or circumferentially eccentric manner with respect to the shaft 2.

SUMMARY OF THE INVENTION

In view of the aforesaid problems, an object of the present invention is to provide a method and device for making the toilet paper taking-up pressure uniform by accurately maintaining the position of a shaft with respect to two rolls parallel at all times, and taking up toilet paper accurately even if the shaft is rotated at high speed, thereby making it possible to improve the quality of the toilet paper roll.

A method for taking up toilet paper according to the present invention, which is devised to solve the above-problems, is characterized in that the taking-up operation is carried out while a shaft for taking up toilet paper adapted to rotate circumferentially is maintained parallel with respect to supporting devices for supporting the toilet paper.

In addition, a device for taking up toilet paper according to the present invention, which is devised in order to solve the above problems, is characterized in that a member is provided which maintains a shaft for taking up toilet paper adapted to rotate circumferentially parallel with respect to supporting devices for supporting the toilet paper.

According to the present invention, since it is possible to maintain a shaft for taking up toilet paper parallel with respect to supporting devices for supporting the toilet paper, the toilet paper taking-up pressure can be made uniform.

Therefore, even if the shaft is rotated at high speed, it is possible to take up toilet paper accurately, thereby making it possible to improve the quality of toilet paper.

DETAILED DESCRIPTION OF THE PREFERRED EMBODIMENTS

Figure 1:
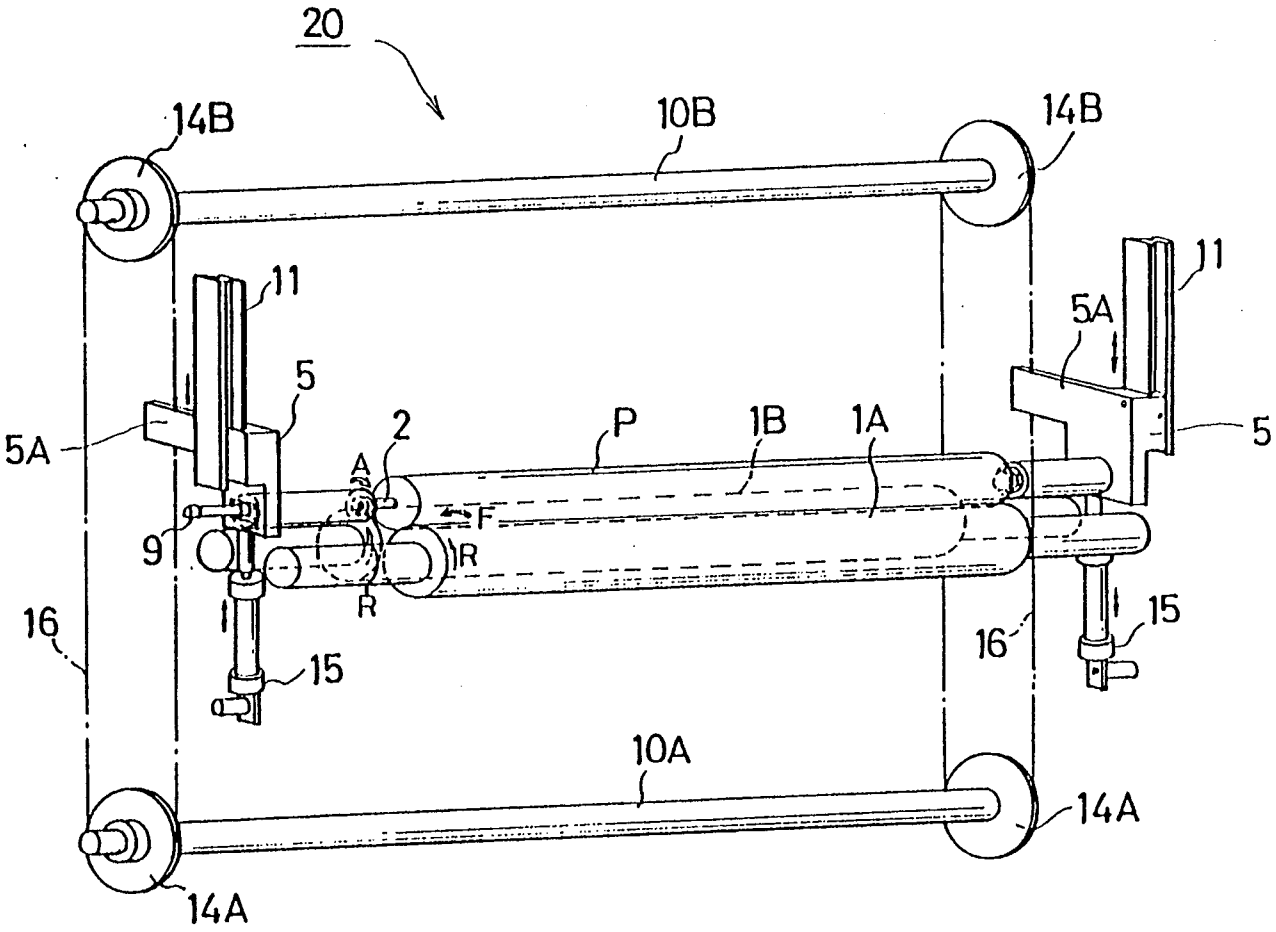
FIG. 1 is a perspective view of the main part of a toilet paper take-up device according to one embodiment of the present invention.

As shown in FIG. 1, a shaft 2 is disposed above a position where a supporting device (roll) 1A and a supporting device (roll) 1B both rotating in a direction indicated by an arrow R are provided adjacent to each other. Wide basic paper for use in toilet paper P is supplied between the shaft 2 and the roll 1A in a direction indicated by an arrow F, and is taken up around the shaft 2. When a taking up operation of toilet paper P is started, air is sent from between the shaft 2 and the roll 1B in a direction indicated by an arrow A so that the leading end of toilet paper P is brought into tight contact with the outer circumference of the shaft 2.

Figure 2:
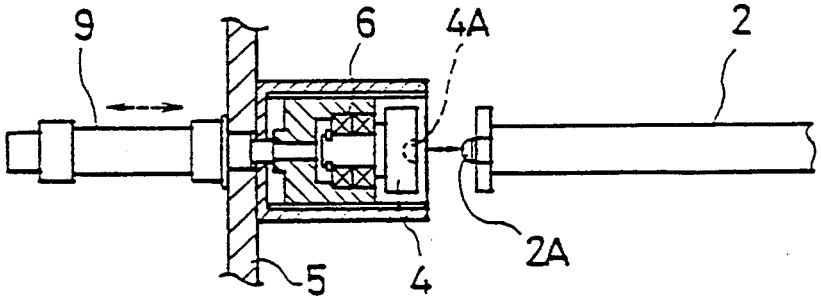
FIG. 2 is a cross-sectional view of the main part of the device shown in FIG. 1 showing the relationship between a shaft and fixing devices.
Figure 3:
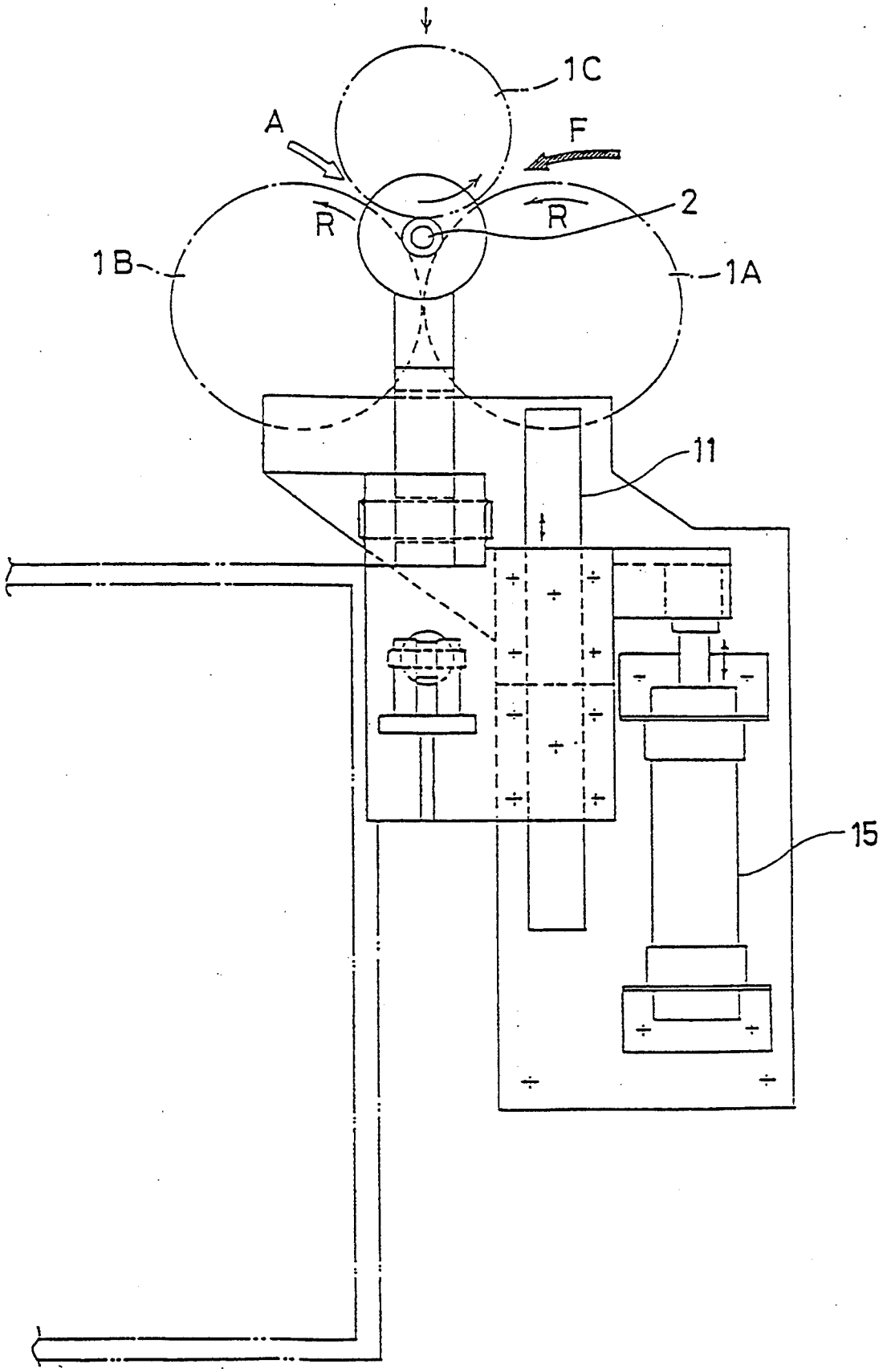
FIG. 3 is a side view of a conventional toilet paper take-up device.
Figure 4:
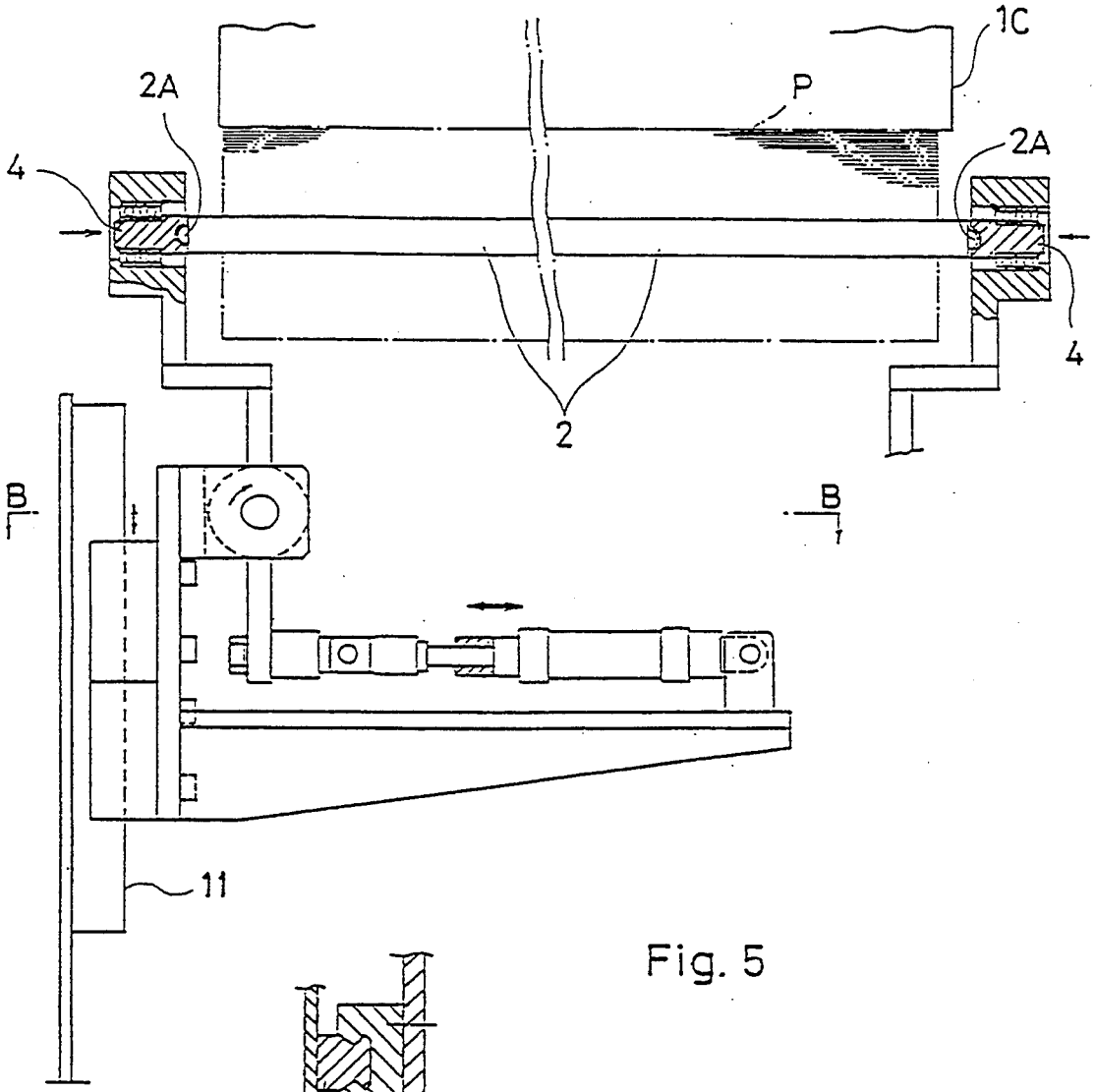
FIG. 4 is a front view of the device shown in FIG. 3.
Figure 5:
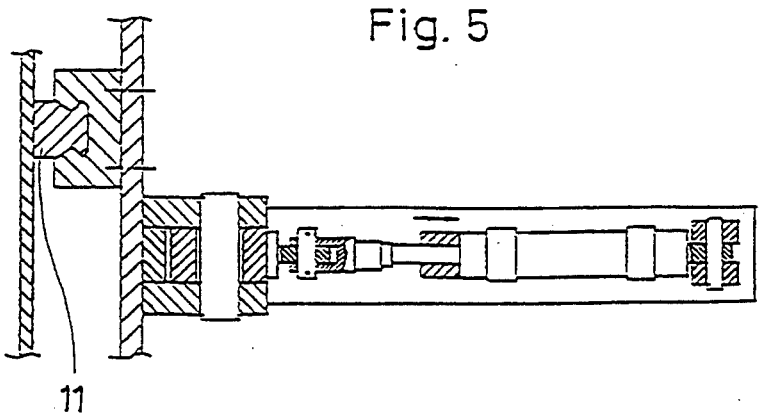
FIG. 5 is a cross-sectional view of the main part of the device taken along the line B—B of FIG. 4.

As shown in FIG. 2, protruding portions 2A are formed at the ends of this shaft 2, respectively, and during taking-up operation, these protruding portions 2A remain fitted into recessed portions 4A formed in fixing devices 4 provided at the ends of the shaft 2. In addition, the shaft 2 is rotatably supported on bearings 6 provided inside the respective fixing devices 4. Furthermore, cylinders 9 are provided at the ends of the shaft 2, respectively, and the recessed portions 4A of the fixing devices 4 are pressed toward the protruding portions 2A of the shaft 2, whereby the shaft 2 is securely retained.

The fixing devices 4 are provided integrally with the lower portions of driving devices 5, and the end portions of respective chains 16 that are formed annular are connected, respectively, to the upper and lower sides of base portions 5A of the driving devices 5. These chains 16 are each passed around a wheel 14A and a wheel 14B at the ends of the shafts 10A and 10B, respectively. The two wheels 14A provided below the shaft 2 are connected to each other by means of a driving shaft 10A, and similarly, the two wheels 14B provided above the shaft 2 are connected to each other by means of a driving shaft 10B.

When a taking-up operation is started, since the weight of toilet paper P that is taken up around the shaft 2 increases, in order to compensate for the increase of weight, the shaft 2 is supported by means of the cylinders 15.

In addition, when rotating either of the driving shafts 10A and 10B in a clockwise or counterclockwise direction by using a power source such as a motor, not shown, the driving devices 5 are vertically moved via the chains 16. At this time, the driving devices 5 are moved along the guide rails 11.

Next, the operation of this take-up device 20 will be described. As a taking-up operation progresses, when the diameter of toilet paper P taken up around the shaft 2 becomes great, the shaft 2 is raised by means of the driving devices 5 so as to maintain at a certain level the contact surface pressure that is generated between the rolls 1A and 1B on one hand and toilet paper P on the other hand.

At this time, the two driving devices 5 provided at the ends of the shaft 2 are raised over an equal distance at all times. This is because the two wheels 14A are connected to each other by means of the driving shaft 10A, while the two wheels 14B are connected to each other by means of the driving shaft 10B, whereby the two chains 16 connected to the two driving devices 5, respectively, are caused to travel over the same absolute distance.

Thus, the shaft 2 remains horizontal when the fixing devices 4 fixing the shaft 2 are raised by means of the driving devices 5. Therefore, the taking-up pressure of toilet paper P also becomes completely uniform, with local generation of a too-tightly-taken-up state on toilet paper P being thereby eliminated.

Moreover, as a taking-up operation progresses, the increase of the aforesaid contact surface pressure is restrained by driving the fixing devices 4, generation of deflection or warpage on the shaft 2 being thereby avoided.

When these operations have been completed, the wheels 14A and 14B are rotated in a counter-clockwise direction so as to lower the driving devices 5 to the initial positions thereof for preparation of another taking-up operation of toilet paper P.

According to the present invention, since the position of the shaft 2 with respect to the rolls 1A and 1B can accurately be maintained horizontal at all times, it is possible to make the taking-up pressure of toilet paper P uniform, and even if the shaft 2 is rotated at high speed, it is possible to take up toilet paper P accurately, whereby the quality of toilet paper roll P can be improved.

What is claimed is:

1. A method of taking up toilet paper in a device that incorporates take-up shaft means, the take-up shaft means including a take-up shaft, for rotatively taking up toilet paper in a roll, first and second support means positioned parallel to and in operative contact with the take-up shaft, and drive means operatively connected to the take-up shaft means for movably positioning the take-up shaft means relative to the first and second support means, said method comprising the steps of:

rolling the toilet paper on the take-up shaft;

operatively positioning the take-up shaft parallel to and in operative contact with the first and second support means so as to generate supporting contact pressure against an entire length of the take-up shaft as toilet paper builds up around the take-up shaft at an initial level; and movably rotating the take-up shaft so as to maintain uniform supportive contact pressure against the entire length of the take-up shaft as the toilet paper builds up around the take-up shaft at the initial level, wherein said step of movably rotating the take-up shaft includes movably driving the take-up shaft vertically while maintaining the take-up shaft substantially horizontal and parallel relative to the first and second supporting means.

2. A method of taking up toilet paper as set forth in claim 1, further comprising the step of:

driving the take-up shaft back to an initial position relative to the first and second support means when a predetermined level of toilet paper is taken up on the take-up shaft.

3. A device for taking up toilet paper, comprising:

take-up shaft means for rotatively taking up toilet paper in a roll, said take-up shaft means including a take-up shaft;

first and second support means positioned parallel to and in operative contact with said take-up shaft, for generating support contact pressure against an entire length of the take-up shaft as toilet paper builds up around said take-up shaft at an initial level; and driving means for rotating said take-up shaft, and, for moving said take-up shaft means away and parallel relative to said first and second support means so as to maintain uniform supportive contact pressure against the entire length of the take-up shaft as the toilet paper builds up around the take-up shaft at the initial level, the driving means being further for moving said take-up shaft means vertically away relative to said first and second support means, wherein said driving means includes first and second drive devices operatively connected at opposing ends of the take-up shaft, the first and second drive devices being operatively connected to each other so as to synchronizingly maintain the take-up shaft in supporting contact parallel with said first and second support means, and a common drive means operatively connected to the first and second drive devices at opposing ends of the take-up shaft, for controlling parallel movement of the first and second drive devices relative to each other so as to maintain the take-up shaft substantially horizontal and in uniform supporting contact parallel with said first and second support means.

4. A device for taking up toilet paper as set forth in claim 3, wherein said take-up shaft means further includes fixing means operatively connected at opposing ends of the take-up shaft, for rotatively supporting the take-up shaft, the fixing means having bearings operatively connected to each of the opposing ends of the take-up shaft.

5. A device for taking up toilet paper as set forth in claim 3, wherein said take-up shaft means further includes lower limit support means for initially supporting the take-up shaft so as to maintain supportive contact pressure against the entire length of the take-up shaft at an initial value.

* * * * *